US011763739B2

(12) United States Patent
Chang et al.

(10) Patent No.: US 11,763,739 B2
(45) Date of Patent: Sep. 19, 2023

(54) METHOD AND DEVICE FOR ADJUSTING BRIGHTNESS AND OLED DISPLAY

(71) Applicants: Chengdu BOE Optoelectronics Technology Co., Ltd., Chengdu (CN); BOE Technology Group Co., Ltd., Beijing (CN)

(72) Inventors: Xiaohuan Chang, Beijing (CN); Lei Feng, Beijing (CN); Shuiming Lv, Beijing (CN); Guoqiang Wu, Beijing (CN)

(73) Assignees: Chengdu BOE Optoelectronics Technology Co., Ltd., Sichuan (CN); BOE Technology Group Co., Ltd., Beijing (CN)

( * ) Notice: Subject to any disclaimer, the term of this patent is extended or adjusted under 35 U.S.C. 154(b) by 205 days.

(21) Appl. No.: 17/414,706

(22) PCT Filed: Dec. 28, 2020

(86) PCT No.: PCT/CN2020/140311
§ 371 (c)(1),
(2) Date: Jun. 16, 2021

(87) PCT Pub. No.: WO2021/190032
PCT Pub. Date: Sep. 30, 2021

(65) Prior Publication Data

US 2022/0406249 A1 Dec. 22, 2022

(30) Foreign Application Priority Data

Mar. 23, 2020 (CN) ..... 202010209280.2

(51) Int. Cl.
*G09G 3/3208* (2016.01)

(52) U.S. Cl.
CPC ... *G09G 3/3208* (2013.01); *G09G 2320/0233* (2013.01); *G09G 2320/064* (2013.01)

(58) Field of Classification Search
CPC .. G09G 3/3208; G09G 5/10; G09G 2320/064; G09G 2320/0626; G09G 2320/0606; G09G 2320/0233
See application file for complete search history.

(56) References Cited

U.S. PATENT DOCUMENTS

2005/0057191 A1 3/2005 Jo et al.
2007/0115302 A1 5/2007 Huang
(Continued)

FOREIGN PATENT DOCUMENTS

CN 1591549 A 3/2005
CN 101458895 A 6/2009
(Continued)

OTHER PUBLICATIONS

CN202010209280.2 First Office Action.
CN202010209280.2 Second Office Action.

*Primary Examiner* — Christopher E Leiby
(74) *Attorney, Agent, or Firm* — IPRO, PLLC

(57) ABSTRACT

Provided by the present disclosure are a method and device for adjusting brightness and an OLED display. The method includes: receiving an instruction for adjusting the brightness of the OLED display; and adjusting the light emitting control signal according to the brightness value of the OLED display which is needed to be adjusted in the instruction. The duty ratio of one pulse period in the light emitting control signal is correspondingly adjusted by one unit each time the brightness of the OLED display needs to be adjusted by one unit.

13 Claims, 3 Drawing Sheets

(56) References Cited

U.S. PATENT DOCUMENTS

| | | | |
|---|---|---|---|
| 2009/0309865 | A1 | 12/2009 | Kohno et al. |
| 2013/0027281 | A1 | 1/2013 | Tomida et al. |
| 2014/0204131 | A1 | 7/2014 | Chen et al. |
| 2017/0092196 | A1 | 3/2017 | Gupta et al. |
| 2018/0114482 | A1 | 4/2018 | Jung |
| 2018/0158398 | A1 | 6/2018 | Xiang et al. |
| 2018/0182279 | A1* | 6/2018 | Sakariya ..... G09G 3/2085 |
| 2020/0074921 | A1 | 3/2020 | Peng et al. |
| 2021/0049957 | A1 | 2/2021 | Lee |
| 2021/0118353 | A1 | 4/2021 | Sakariya et al. |

FOREIGN PATENT DOCUMENTS

| | | | |
|---|---|---|---|
| CN | 101707040 | A | 5/2010 |
| CN | 101866612 | A | 10/2010 |
| CN | 103077684 | A | 5/2013 |
| CN | 106409238 | A | 2/2017 |
| CN | 106558285 | A | 4/2017 |
| CN | 107481673 | A | 12/2017 |
| CN | 107735832 | A | 2/2018 |
| CN | 107945745 | A | 4/2018 |
| CN | 107978270 | A | 5/2018 |
| CN | 108346399 | A | 7/2018 |
| CN | 108665869 | A | 10/2018 |
| CN | 111243520 | A | 6/2020 |
| KR | 20170132401 | A | 12/2017 |
| KR | 20190122056 | A | 10/2019 |
| WO | 2020004743 | A1 | 1/2020 |

* cited by examiner

METHOD AND DEVICE FOR ADJUSTING BRIGHTNESS AND OLED DISPLAY

CROSS-REFERENCE TO RELATED APPLICATIONS

The present application is a US National Stage of International Application No. PCT/CN2020/140311, filed on Dec. 28, 2020, which claims the priority to a Chinese patent application No. 202010209280.2, filed to the Patent Office of the People's Republic of China on Mar. 23, 2020 and entitled "METHOD AND DEVICE FOR ADJUSTING BRIGHTNESS AND OLED DISPLAY", the entire contents of which are incorporated herein by reference.

FIELD

The present disclosure relates to the technical field of a display, in particular to a method and device for adjusting brightness and an OLED display.

BACKGROUND

An organic light emitting diode (OLED) display is one of the hotspots in the field of flat panel display research, and has the advantages of low energy consumption, low production cost, self-luminescence, wide viewing angle and fast response speed compared with a liquid crystal display. At present, the OLED display has begun to replace a traditional liquid crystal display (LCD) in the flat panel display fields such as mobile phones, PDAs and digital cameras.

For OLED displays, pixels are controlled to emit light under the action of light emitting control signals. For example, a pixel emits light when the light emitting control signal is at a low level; and the pixel does not emit light when the light emitting control signal is at a high level. For controlling the brightness of the display, the most commonly used method is to adjust the ratio of high and low levels in the light emitting control signals, as shown in FIG. 1, that is, in a frame of time, the longer the low-level time in the light emitting control signals Emit (1)~Emit (N) is, the higher the brightness of the display is; moreover, the shorter the low-level time in the light emitting control signals is, the lower the brightness of the display is. In a frame of time, in order to avoid display problems caused by long-time bright or dark pixels, several pulse periods are usually designed in a light emitting control signal. In each pulse period, the low level means that the pixels in this row light up, and the high level means that the pixels in this row do not emit light. Therefore, the higher the duty ratio of the low level in the light emitting control signal, the longer the light-emitting time, and the higher the brightness of the corresponding display.

Existing OLED display, e.g., smart phones, may be controlled by sliding a screen brightness bar in the process of adjusting the brightness. However, when sliding the brightness bar, the pulse width modulation (PWM) function is generally used to adjust the brightness, that is, every time the brightness of OLED display is adjusted by one unit, the width of the lighting time for all pulse periods of the lighting control signal is needed to be adjusted at the same time, which leads to excessive brightness jump when adjusting the brightness bar, and affects the user experience.

SUMMARY

Embodiments of the present disclosure provide a method and device for adjusting brightness and an OLED display. The specific solution is as follows:

an embodiment of the present disclosure provides a method for adjusting brightness of an OLED display, where when the OLED display displays each frame, a light emitting control signal sent to each row of pixels has N pulse periods; N is an integer greater than or equal to 2; and the method for adjusting brightness comprises:

receiving an instruction for adjusting the brightness of the OLED display; and adjusting the light emitting control signal according to a brightness value of the OLED display which is needed to be adjusted in the instruction; where a duty ratio of one pulse period in the light emitting control signal is correspondingly adjusted by one unit each time the brightness of the OLED display needs to be adjusted by one unit; and the greater the duty ratio, the higher the brightness of the display.

Optionally, according to the method for adjusting brightness provided by the embodiment of the present disclosure, an operation that the duty ratio of one pulse period in the light emitting control signal is correspondingly adjusted by one unit each time the brightness of the OLED display needs to be adjusted by one unit, specifically comprises that:

the duty ratio of the pulse period with a minimum duty ratio in the light emitting control signal is correspondingly increased by one unit each time the brightness of the OLED display needs to be increased by one unit.

Optionally, according to the method for adjusting brightness provided by the embodiment of the present disclosure, an operation that the duty ratio of one pulse period in the light emitting control signal is correspondingly adjusted by one unit each time the brightness of the OLED display needs to be adjusted by one unit, specifically comprises that:

the duty ratio of the pulse period with a maximum duty ratio in the light emitting control signal is correspondingly reduced by one unit each time the brightness of the OLED display needs to be lowered by one unit.

Optionally, according to the method for adjusting brightness provided by the embodiment of the present disclosure, the adjusting the light emitting control signal according to the brightness value of the OLED display which is needed to be adjusted in the instruction, specifically includes:

continuously adjusting the light emitting control signal for M times when the brightness of the OLED display needs to be continuously increased by M units according to the instruction; where the duty ratio of one pulse period in the light emitting control signal is correspondingly adjusted by one unit each time, the pulse periods of the light emitting control signal continuously adjusted twice are different, and M is an integer greater than 1.

Optionally, according to the method for adjusting brightness provided by the embodiment of the present disclosure, the pulse periods of the light emitting control signal continuously adjusted twice are not adjacent.

Optionally, according to the method for adjusting brightness provided by the embodiment of the present disclosure, the pulse periods of the light emitting control signal continuously adjusted twice are separated by one pulse period.

Optionally, according to the method for adjusting brightness provided by the embodiment of the present disclosure, the duty ratios of the pulse periods at the odd positions in the light emitting control signal are preferentially adjusted; and the duty ratios of the pulse periods at the even positions in the light emitting control signal are adjusted when the duty ratios of the pulse periods at the odd positions are all adjusted; or the duty ratios of the pulse periods at the even positions in the light emitting control signal are preferentially adjusted; the duty ratios of the pulse periods at the odd positions in the light emitting control signal are adjusted when the duty ratios of the pulse periods at the even positions are all adjusted.

Accordingly, an embodiment of the present disclosure also provides a device for adjusting brightness of an OLED display device, where the device for adjusting brightness includes:

a receiving module, configured to receive an instruction for adjusting the brightness of the OLED display; and an adjusting module, configured to adjust a light emitting control signal according to a brightness value of the OLED display which is needed to be adjusted in the instruction; where a duty ratio of one pulse period in the light emitting control signal is correspondingly adjusted by one unit each time the brightness of the OLED display needs to be adjusted by one unit; and the greater the duty ratio, the higher the brightness of the display.

Optionally, according to the device for adjusting brightness provided by the embodiment of the present disclosure, the adjusting module is configured to correspondingly adjust the duty ratio of one pulse period in the light emitting control signal by one unit each time the brightness of the OLED display needs to be adjusted by one unit according to the instruction, is specifically configured that:

the duty ratio of the pulse period with a minimum duty ratio in the light emitting control signal is correspondingly increased by one unit each time the brightness of the OLED display needs to be increased by one unit.

Optionally, according to the device for adjusting brightness provided by the embodiment of the present disclosure, the adjusting module configured to correspondingly adjust the duty ratio of one pulse period in the light emitting control signal by one unit each time the brightness of the OLED display needs to be adjusted by one unit according to the instruction, is specifically configured that:

the duty ratio of the pulse period with a maximum duty ratio in the light emitting control signal is correspondingly reduced by one unit each time the brightness of the OLED display needs to be lowered by one unit.

Optionally, according to the device for adjusting brightness provided by the embodiment of the present disclosure, the adjusting module is specifically configured to:

continuously adjust the light emitting control signal for M times when the brightness of the OLED display needs to be continuously increased by M units according to the instruction; where the duty ratio of one pulse period in the light emitting control signal is correspondingly adjusted by one unit each time, pulse periods of the light emitting control signal continuously adjusted twice are different, and M is an integer greater than 1.

Optionally, according to the device for adjusting brightness provided by the embodiment of the present disclosure, the adjusting module is configured that the pulse periods of the light emitting control signal continuously adjusted twice are not adjacent.

Optionally, according to the device for adjusting brightness provided by the embodiment of the present disclosure, the adjusting module is configured that the pulse periods of the light emitting control signal continuously adjusted twice are separated by one pulse period.

Optionally, according to the device for adjusting brightness provided by the embodiment of the present disclosure, the adjusting module is configured that: the duty ratios of the pulse periods at the odd positions in the light emitting control signal are preferentially adjusted; and the duty ratios of the pulse periods at the even positions in the light emitting control signal are adjusted when the duty ratios of the pulse periods at the odd positions are all adjusted; or the adjusting module is configured that: the duty ratios of the pulse periods at the even positions in the light emitting control signal are preferentially adjusted; the duty ratios of the pulse periods at the odd positions in the light emitting control signal are adjusted when the duty ratios of the pulse periods at the even positions are all adjusted.

Accordingly, an embodiment of the present disclosure also provides an OLED display, including a display panel and any one of the devices for adjusting brightness provided by an embodiment of the disclosure.

DETAILED DESCRIPTION OF THE EMBODIMENTS

Figure 1:
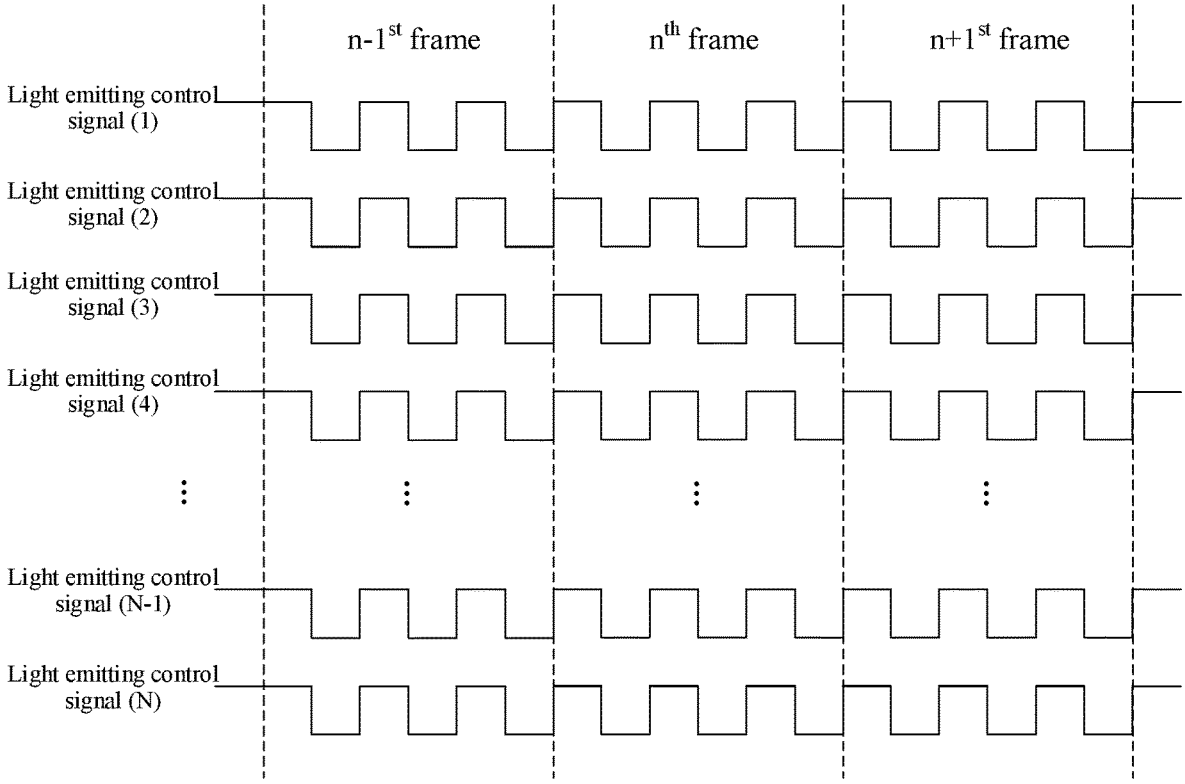
FIG. 1 is a light emitting sequence diagram corresponding to an OLED display in the related art.

In order to make the above objects, features and advantages of the present disclosure more obvious and understandable, the present disclosure will be further described below in connection with the accompanying drawings and embodiments. However, the exemplary embodiments may be implemented in many forms and should not be construed as limited to the embodiments set forth herein. Rather, these exemplary embodiments are provided so that the present disclosure is thorough and complete, and the concept of these exemplary embodiments will be fully conveyed to those skilled in the art. In the drawings, the same reference numerals denote the same or similar structures, and thus repeated descriptions thereof will be omitted. The words expressing position and direction described in the present disclosure are all illustrated with the attached drawings as an example, but they may be changed as needed, and all the changes are included in the scope of protection of the present disclosure. The drawings of the present disclosure are only used to illustrate a relative positional relationship rather than represent a true scale.

It should be noted that specific details are set forth in the following description to facilitate a full understanding of the present disclosure. However, the present disclosure may be implemented in a variety of other ways different from those described herein, and those skilled in the art may make similar extensions without contradicting the context of the present disclosure. The present disclosure is therefore not limited by the specific embodiments disclosed below. The following description of the specification is a preferred embodiment for implementing the present application, and is intended to explain the general principles of the present application rather than limit the scope thereof. The scope of protection of the present application shall be as defined by the claims appended thereto.

The method and device for adjusting brightness and the OLED display provided by the embodiments of the present disclosure will be described in detail with reference to the accompanying drawings.

Figure 2:
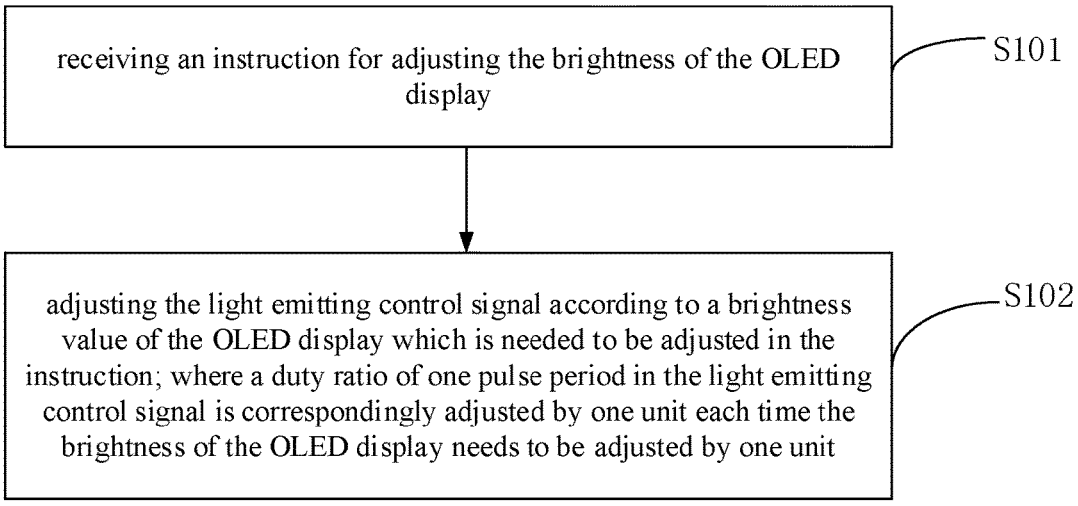
FIG. 2 is a flow chart of a method for adjusting brightness of an OLED display provided by the embodiment of the present disclosure.

According to a method for adjusting brightness of an OLED display provided by the embodiment of the present disclosure, when the OLED display displays each frame, a light emitting control signal sent to each row of pixels has N pulse periods; and N is an integer greater than or equal to 2. As shown in FIG. 2, the method for adjusting brightness includes the following.

S101. receiving an instruction for adjusting the brightness of the OLED display.

S102. adjusting the light emitting control signal according to a brightness value of the OLED display which is needed to be adjusted in the instruction; where a duty ratio of one pulse period in the light emitting control signal is correspondingly adjusted by one unit each time the brightness of the OLED display needs to be adjusted by one unit; and the greater the duty ratio of the pulse period, the higher the brightness of the display.

The method for adjusting brightness provided by the embodiment of the present disclosure includes: receiving an instruction for adjusting the brightness of the OLED display; and adjusting the light emitting control signal according to the brightness value of the OLED display which is needed to be adjusted in the instruction. The duty ratio of one pulse period in the light emitting control signal is correspondingly adjusted by one unit each time the brightness of the OLED display needs to be adjusted by one unit, which reduces the brightness value of one unit of brightness of the OLED display, avoids excessive brightness jump when the display adjusts the brightness bar, and improves the user experience compared with the existing methods for adjusting brightness.

In a specific implementation, optionally, according to the method for adjusting brightness provided by the embodiment of the present disclosure, the operation that the duty ratio of one pulse period in the light emitting control signal is correspondingly adjusted by one unit each time the brightness of the OLED display needs to be adjusted by one unit, specifically comprises that:

the duty ratio of the pulse period with a minimum duty ratio in the light emitting control signal is correspondingly increased by one unit each time the brightness of the OLED display needs to be increased by one unit. Namely, the duty ratio of the pulse period with the minimum duty ratio in the light emitting control signal is increased when the brightness of the display device is increased; therefore, the big difference of the duty ratios of different pulse periods in the same light emitting control signal is avoided, and the brightness distribution uniformity of a single frame picture will not be affected. Optionally, according to the method for adjusting brightness provided by the embodiment of the present disclosure, the operation that the duty ratio of one pulse period in the light emitting control signal is correspondingly adjusted by one unit each time the brightness of the OLED display needs to be adjusted by one unit, specifically comprises that:

the duty ratio of the pulse period with a maximum duty ratio in the light emitting control signal is correspondingly reduced by one unit each time the brightness of the OLED display needs to be lowered by one unit. Namely, the duty ratio of the pulse period with the maximum duty ratio in the light emitting control signal is lowered when the brightness of the display device is increased; therefore, the big difference of the duty ratios of different pulse periods in the same light emitting control signal is avoided, and the brightness distribution uniformity of a single frame picture will not be affected.

Optionally, according to the method for adjusting brightness provided by the embodiment of the present disclosure, the adjusting the light emitting control signal according to the brightness value of the OLED display which is needed to be adjusted in the instruction, specifically comprises:

continuously adjusting the light emitting control signal for M times when the brightness of the OLED display is continuously increased by M units according to the instruction; where the duty ratio of one pulse period in the light emitting control signal is correspondingly adjusted by one unit each time, pulse periods of the light emitting control signal continuously adjusted twice are different, and M is an integer greater than 1. In this way, the following condition may be avoided: the duty ratio of the same pulse period in the light emitting control signal corresponding to the pixels in the same row is always adjusted, resulting in great differences in duty ratios of different pulse periods in the subsequent same light emitting control signal, and affecting the brightness distribution uniformity of a single frame picture.

Optionally, according to the method for adjusting brightness provided by the embodiment of the present disclosure, the pulse periods of the light emitting control signal continuously adjusted twice are not adjacent. Therefore, the pulse periods with different duty ratios in the same lighting control signals may be uniformly distributed, and the brightness distribution uniformity of a single frame picture may be ensured.

Optionally, according to the method for adjusting brightness provided by the embodiment of the present disclosure, the pulse periods of the light emitting control signal continuously adjusted twice are separated by one pulse period. Therefore, the pulse periods with different duty ratios in the same lighting control signals may be uniformly distributed, and the brightness distribution uniformity of a single frame picture may be ensured.

Optionally, according to the method for adjusting brightness provided by the embodiment of the present disclosure, duty ratios of pulse periods at odd positions in the light emitting control signal are preferentially adjusted, and duty ratios of pulse periods at even positions in the light emitting control signal are adjusted when the duty ratios of the pulse periods at the odd positions are all adjusted; or, duty ratios of pulse periods at even positions in the light emitting control signal are preferentially adjusted, and duty ratios of pulse periods at odd positions in the light emitting control signal are adjusted when the duty ratios of the pulse periods at the even positions are all adjusted. Therefore, the pulse periods with different duty ratios in the same lighting control signal may be uniformly distributed, and the brightness distribution uniformity of a single frame picture may be ensured.

Specifically, if N=4, for example, the duty ratios of the pulse periods at positions 1 and 3 in the light emitting control signal are preferentially adjusted. If the duty ratios of the pulse periods at positions 1 and 3 have been adjusted, the duty ratios of the pulse periods at positions 2 and 4 in the light emitting control signal may be adjusted. Or, the duty ratios of the pulse periods at positions 2 and 4 in the light emitting control signal are preferentially adjusted. If the duty ratios of the pulse periods at positions 2 and 4 have been adjusted, the duty ratios of the pulse periods at positions 1 and 3 in the light emitting control signal may be adjusted.

In a specific implementation, in an OLED display device, one unit of the duty ratio of one pulse period is generally equal to the scanning time of M rows of pixels, for example, M=4; thus, increasing the duty ratio of one pulse period by one unit is equivalent to extending the light emitting time of one pulse period by M rows of scanning time.

The method for adjusting brightness provided by the embodiment of the present disclosure will be explained by specific embodiments below.

Figure 3:
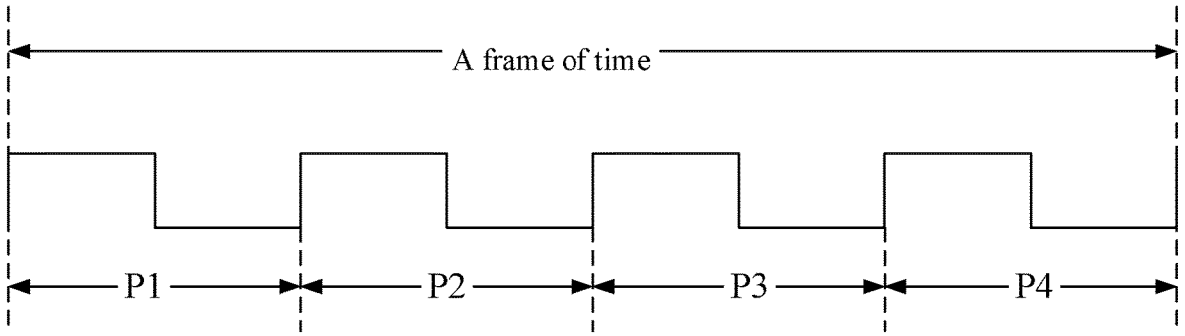
FIG. 3 is a sequence diagram of a light emitting control signal provided by the embodiment of the present disclosure.

In one embodiment, for example, as shown in FIG. 3, in a frame of time, each light emitting control signal Emit has four pulse periods: P1-P4, and the method for adjusting brightness is shown in Table 1 below.

TABLE 1

| DBV (display brightness value) | A frame of time | | | |
|---|---|---|---|---|
| | P1 | P2 | P3 | P4 |
| N | $X_0$ | $X_0$ | $X_0$ | $X_0$ |
| N + 1 | $X_0 + 1$ | $X_0$ | $X_0$ | $X_0$ |
| N + 2 | $X_0 + 1$ | $X_0$ | $X_0 + 1$ | $X_0$ |
| N + 3 | $X_0 + 1$ | $X_0 + 1$ | $X_0 + 1$ | $X_0$ |
| N + 4 | $X_0 + 1$ | $X_0 + 1$ | $X_0 + 1$ | $X_0 + 1$ |

When the DBV of the OLED display needs to be adjusted from N to N+1, the duty ratio of a first pulse period P1 in the light emitting control signal Emit is correspondingly increased by one unit, while the duty ratios of a second pulse period P2, a third pulse period P3 and a fourth pulse period P4 are unchanged. Where, Xo represents an initial duty ratio of each pulse period in the light emitting control signal Emit.

When the DBV of the OLED display needs to be adjusted from N to N+2, the duty ratio of the first pulse period P1 in the light emitting control signal Emit is correspondingly increased by one unit, while the duty ratios of the second pulse period P2, the third pulse period P3 and the fourth pulse period P4 are unchanged, so that the DBV of the OLED display is adjusted from N to N+1. Then, the duty ratio of the third pulse period P3 in the light emitting control signal Emit is correspondingly increased by one unit, while the duty ratios of the first pulse period P1, the second pulse period P2 and the fourth pulse period P4 are unchanged, so that the DBV of the OLED display is adjusted from N+1 to N+2.

When the DBV of the OLED display needs to be adjusted from N to N+3, the duty ratio of the first pulse period P1 in the light emitting control signal Emit is correspondingly increased by one unit, while the duty ratios of the second pulse period P2, the third pulse period P3 and the fourth pulse period P4 are unchanged, so that the DBV of the OLED display is adjusted from N to N+1. Then, the duty ratio of the third pulse period P3 in the light emitting control signal Emit is correspondingly increased by one unit, while the duty ratios of the first pulse period P1, the second pulse period P2 and the fourth pulse period P4 are unchanged, so that the DBV of the OLED display is adjusted from N+1 to N+2. In turn, the duty ratio of the second pulse period P2 in the light emitting control signal Emit is correspondingly increased by one unit, while the duty ratios of the first pulse period P1, the third pulse period P3 and the fourth pulse period P4 are unchanged, so that the DBV of the OLED display is adjusted from N+2 to N+3.

When the DBV of the OLED display needs to be adjusted from N to N+4, the duty ratio of the first pulse period P1 in the light emitting control signal Emit is correspondingly increased by one unit, while the duty ratios of the second pulse period P2, the third pulse period P3 and the fourth pulse period P4 are unchanged, so that the DBV of the OLED display is adjusted from N to N+1. Then, the duty ratio of the third pulse period P3 in the light emitting control signal Emit is correspondingly increased by one unit, while the duty ratios of the first pulse period P1, the second pulse period P2 and the fourth pulse period P4 are unchanged, so that the DBV of the OLED display is adjusted from N+1 to N+2. In turn, the duty ratio of the second pulse period P2 in the light emitting control signal Emit is correspondingly increased by one unit, while the duty ratios of the first pulse period P1, the third pulse period P3 and the fourth pulse period P4 are unchanged, so that the DBV of the OLED display is adjusted from N+2 to N+3. In turn, the duty ratio of the fourth pulse period P4 in the light emitting control signal Emit is correspondingly increased by one unit, while the duty ratios of the first pulse period P1, the second pulse period P2 and the third pulse period P3 are unchanged, so that the DBV of the OLED display is adjusted from N+3 to N+4.

By analogy, when the DBV of the OLED display is adjusted from N to N+4n+X, if X=1, the duty ratio of the first pulse period P1 in the light emitting control signal Emit is increased by n+1 units, while the duty ratios of other pulse periods (P2, P3 and P4) are increased by n units respectively. If X=2, the duty ratios of the first and third pulse periods (P1 and P3) in the light emitting control signal Emit are increased by n+1 units respectively, while the duty ratios of other pulse periods (P2 and P4) are increased by n units respectively. If X=3, the duty ratios of the first, third and second pulse periods (P1, P3 and P2) in the light emitting control signal Emit are increased by n+1 units respectively, while the duty ratio of the fourth pulse period P4 is increased by n units. If X=4, the duty ratios of various pulse periods (P1, P2, P3 and P4) in the light emitting control signal Emit is increased by n+1 unit respectively.

To sum up, according to the method for adjusting brightness provided by the embodiment of the present disclosure, as shown in Table 1, the duty ratio of each pulse period is sequentially adjusted in the order of 1→3→2→4, so that the duty ratio of the same pulse period in the light emitting control signal does not change greatly, and the brightness uniformity of the display picture is ensured.

Figure 4:
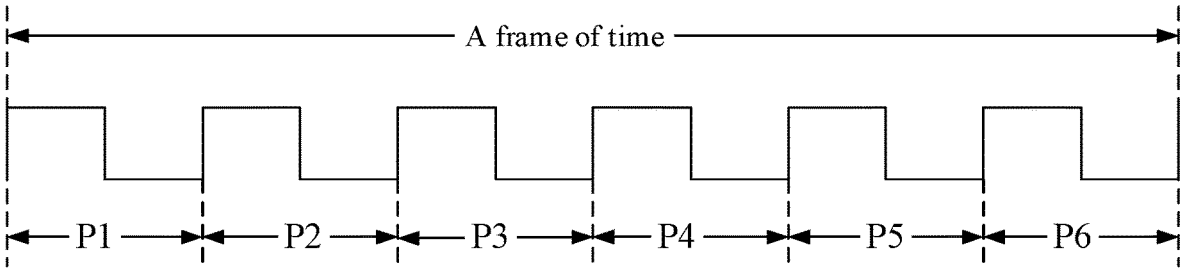
FIG. 4 is another sequence diagram of a light emitting control signal provided by the embodiment of the present disclosure.

In another embodiment, for example, as shown in FIG. 4, each light emitting control signal Emit has six pulse periods P1-P6 in a frame of time, and the method for adjusting brightness is shown in Table 2 below.

TABLE 2

| | A frame of time | | | | | |
|---|---|---|---|---|---|---|
| DBV | P1 | P2 | P3 | P4 | P5 | P6 |
| N | $X_0$ | $X_0$ | $X_0$ | $X_0$ | $X_0$ | $X_0$ |
| N + 1 | $X_0 + 1$ | $X_0$ | $X_0$ | $X_0$ | $X_0$ | $X_0$ |
| N + 2 | $X_0 + 1$ | $X_0$ | $X_0 + 1$ | $X_0$ | $X_0$ | $X_0$ |

TABLE 2-continued

| | A frame of time | | | | | |
|---|---|---|---|---|---|---|
| DBV | P1 | P2 | P3 | P4 | P5 | P6 |
| N + 3 | $X_0 + 1$ | $X_0$ | $X_0 + 1$ | $X_0$ | $X_0 + 1$ | $X_0$ |
| N + 4 | $X_0 + 1$ | $X_0 + 1$ | $X_0 + 1$ | $X_0$ | $X_0 + 1$ | $X_0$ |
| N + 5 | $X_0 + 1$ | $X_0 + 1$ | $X_0 + 1$ | $X_0 + 1$ | $X_0 + 1$ | $X_0$ |
| N + 6 | $X_0 + 1$ | $X_0 + 1$ | $X_0 + 1$ | $X_0 + 1$ | $X_0 + 1$ | $X_0 + 1$ |

When the DBV of the OLED display needs to be adjusted from N to N+1, the duty ratio of the first pulse period P1 in the light emitting control signal Emit is correspondingly increased by one unit, while the duty ratios of other pulse periods (P2, P3, P4, P5 and P6) are unchanged. Where Xo represents an initial duty ratio of each pulse period P in the light emitting control signal Emit.

When the DBV of the OLED display needs to be adjusted from N to N+2, the duty ratio of the first pulse period P1 in the light emitting control signal Emit is correspondingly increased by one unit, while the duty ratios of other pulse periods (P2, P3, P4, P5 and P6) are unchanged, so that the DBV of the OLED display is adjusted from N to N+1. Then, the duty ratio of the third pulse period P3 in the light emitting control signal Emit is correspondingly increased by one unit, while the duty ratios of other pulse periods (P1, P2, P4, P5 and P6) are unchanged, so that the DBV of the OLED display is adjusted from N+1 to N+2.

When the DBV of the OLED display needs to be adjusted from N to N+3, the duty ratio of the first pulse period P1 in the light emitting control signal Emit is correspondingly increased by one unit, while the duty ratios of other pulse periods (P2, P3, P4, P5 and P6) are unchanged, so that the DBV of the OLED display is adjusted from N to N+1. Then, the duty ratio of the third pulse period P3 in the light emitting control signal Emit is correspondingly increased by one unit, while the duty ratios of other pulse periods (P1, P2, P4, P5 and P6) are unchanged, so that the DBV of the OLED display is adjusted from N+1 to N+2. In turn, the duty ratio of the fifth pulse period P5 in the light emitting control signal Emit is correspondingly increased by one unit, while the duty ratios of other pulse periods (P1, P2, P3, P4 and P6) are unchanged, so that the DBV of the OLED display is adjusted from N+2 to N+3.

When the DBV of the OLED display needs to be adjusted from N to N+4, the duty ratio of the first pulse period P1 in the light emitting control signal Emit is correspondingly increased by one unit, while the duty ratios of other pulse periods (P2, P3, P4, P5 and P6) are unchanged, so that the DBV of the OLED display is adjusted from N to N+1. Then, the duty ratio of the third pulse period P3 in the light emitting control signal Emit is correspondingly increased by one unit, while the duty ratios of other pulse periods (P1, P2, P4, P5 and P6) are unchanged, so that the DBV of the OLED display is adjusted from N+1 to N+2. In turn, the duty ratio of the fifth pulse period P5 in the light emitting control signal Emit is correspondingly increased by one unit, while the duty ratios of other pulse periods (P1, P2, P3, P4 and P6) are unchanged, so that the DBV of the OLED display is adjusted from N+2 to N+3. In turn, the duty ratio of the second pulse period P2 in the light emitting control signal Emit is correspondingly increased by one unit, while the duty ratios of other pulse periods (P1, P3, P4, P5 and P6) are unchanged, so that the DBV of the OLED display is adjusted from N+3 to N+4.

When the DBV of the OLED display needs to be adjusted from N to N+5, the duty ratio of the first pulse period P1 in the light emitting control signal Emit is correspondingly increased by one unit, while the duty ratios of other pulse periods (P2, P3, P4, P5 and P6) are unchanged, so that the DBV of the OLED display is adjusted from N to N+1. Then, the duty ratio of the third pulse period P3 in the light emitting control signal Emit is correspondingly increased by one unit, while the duty ratios of other pulse periods (P1, P2, P4, P5 and P6) are unchanged, so that the DBV of the OLED display is adjusted from N+1 to N+2. In turn, the duty ratio of the fifth pulse period P5 in the light emitting control signal Emit is correspondingly increased by one unit, while the duty ratios of other pulse periods (P1, P2, P3, P4 and P6) are unchanged, so that the DBV of the OLED display is adjusted from N+2 to N+3. In turn, the duty ratio of the second pulse period P2 in the light emitting control signal Emit is correspondingly increased by one unit, while the duty ratios of other pulse periods (P1, P3, P4, P5 and P6) are unchanged, so that the DBV of the OLED display is adjusted from N+3 to N+4. In turn, the duty ratio of the fourth pulse period P4 in the light emitting control signal Emit is correspondingly increased by one unit, while the duty ratios of other pulse periods (P1, P2, P3, P5 and P6) are unchanged, so that the DBV of the OLED display is adjusted from N+4 to N+5.

When the DBV of the OLED display needs to be adjusted from N to N+6, the duty ratio of the first pulse period P1 in the light emitting control signal Emit is correspondingly increased by one unit, while the duty ratios of other pulse periods (P2, P3, P4, P5 and P6) are unchanged, so that the DBV of the OLED display is adjusted from N to N+1. Then, the duty ratio of the third pulse period P3 in the light emitting control signal Emit is correspondingly increased by one unit, while the duty ratios of other pulse periods (P1, P2, P4, P5 and P6) are unchanged, so that the DBV of the OLED display is adjusted from N+1 to N+2. In turn, the duty ratio of the fifth pulse period P5 in the light emitting control signal Emit is correspondingly increased by one unit, while the duty ratios of other pulse periods (P1, P2, P3, P4 and P6) are unchanged, so that the DBV of the OLED display is adjusted from N+2 to N+3. In turn, the duty ratio of the second pulse period P2 in the light emitting control signal Emit is correspondingly increased by one unit, while the duty ratios of other pulse periods (P1, P3, P4, P5 and P6) are unchanged, so that the DBV of the OLED display is adjusted from N+3 to N+4. In turn, the duty ratio of the fourth pulse period P4 in the light emitting control signal Emit is correspondingly increased by one unit, while the duty ratios of other pulse periods (P1, P2, P3, P5 and P6) are unchanged, so that the DBV of the OLED display is adjusted from N+4 to N+5. In turn, the duty ratio of the sixth pulse period P6 in the light emitting control signal Emit is correspondingly increased by one unit, while the duty ratios of other pulse periods (P1, P2, P3, P4 and P5) are unchanged, so that the DBV of the OLED display is adjusted from N+5 to N+6.

By analogy, when the DBV of the OLED display is adjusted from N to N+6n+X, if X=1, the duty ratio of the first pulse period P1 in the light emitting control signal Emit is increased by n+1 units, while the duty ratios of other pulse periods (P2, P3, P4, P5 and P6) are increased by n units respectively. If X=2, the duty ratios of the first and third pulse periods (P1 and P3) in the light emitting control signal Emit are increased by n+1 units respectively, while the duty ratios of other pulse periods (P2, P4, P5 and P6) are increased by n units respectively. If X=3, the duty ratios of the first, third and fifth pulse periods (P1, P3 and P5) in the light emitting control signal Emit are increased by n+1 units respectively, while the duty ratios of other pulse periods (P2, P4 and P6) are increased by n units respectively. If X=4, the duty ratios of the first, third, fifth and second pulse periods (P1, P3, P5 and P2) in the light emitting control signal Emit are increased by n+1 units respectively, while the duty ratios of other pulse periods (P4 and P6) are increased by n units respectively. If X=5, the duty ratios of the first, third, fifth, second and fourth pulse periods (P1, P3, P5, P2 and P4) in the light emitting control signal Emit are increased by n+1 units respectively, while the duty ratio of the sixth pulse period P6 is increased by n units. If X=6, the duty ratios of various pulse periods (P1, P2, P3, P4, P5 and P6) in the light emitting control signal Emit is increased by n+1 units respectively.

To sum up, according to the method for adjusting brightness provided by the embodiment of the present disclosure, as shown in Table 2, the duty ratio of each pulse period is sequentially adjusted in the order of 1→3→5→2→4→6, so that the duty ratio of the same pulse period in the light emitting control signal does not change greatly, and the brightness uniformity of the display picture is ensured.

It should be noted that the embodiments of the present disclosure are all explained by, for example, providing the brightness of the display device, and the principle of reducing the brightness of the display device is the same, which is not repeated here.

Figure 5:
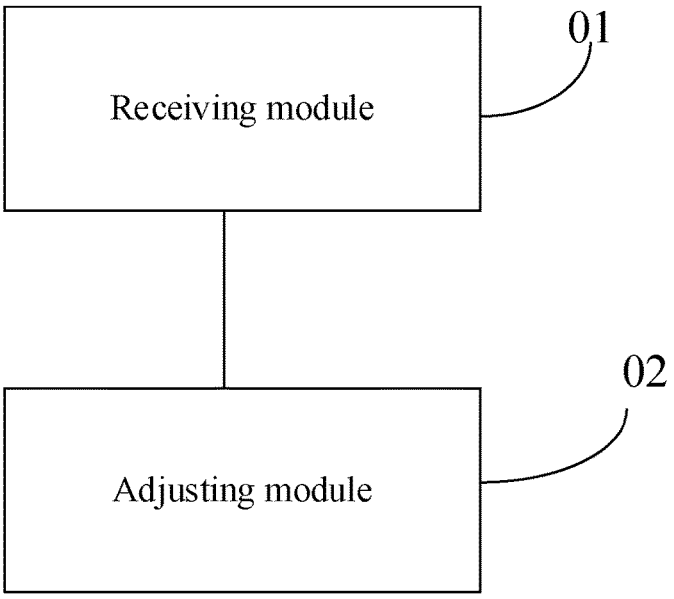
FIG. 5 is a structural schematic diagram of a device for adjusting brightness provided by the embodiment of the present disclosure.

Based on the same inventive concept, an embodiment of the present disclosure also provides a device for adjusting brightness of an OLED display device, as shown in FIG. 5, and the device for adjusting brightness includes:

a receiving module 01, configured to receive an instruction for adjusting the brightness of the OLED display; and an adjusting module 02, configured to adjust a light emitting control signal according to a brightness value of the OLED display which is needed to be adjusted in the instruction; wherein a duty ratio of one pulse period in the light emitting control signal is correspondingly adjusted by one unit each time the brightness of the OLED display needs to be adjusted by one unit; and the greater the duty ratio, the higher the brightness of the display.

The device for adjusting brightness provided by the embodiment of the present disclosure includes a receiving module and an adjusting module, where the receiving module is configured to receive an instruction for adjusting the brightness of an OLED display; and the adjusting module is configured to adjust the light emitting control signal according to the brightness value of the OLED display which is needed to be adjusted in the instruction. The duty ratio of one pulse period in the light emitting control signal is correspondingly adjusted by one unit each time the brightness of the OLED display needs to be adjusted by one unit, which reduces the brightness value of one unit of brightness of the OLED display, avoids excessive brightness jump when the display adjusts the brightness bar, and improves the user experience compared with the existing methods for adjusting brightness.

Optionally, according to the device for adjusting brightness provided by the embodiment of the present disclosure, the adjusting module configured to correspondingly adjust the duty ratio of one pulse period in the light emitting control signal by one unit each time the brightness of the OLED display needs to be adjusted by one unit according to the instruction, is specifically configured that:

the duty ratio of the pulse period with a minimum duty ratio in the light emitting control signal is correspondingly increased by one unit each time the brightness of the OLED display needs to be increased by one unit.

Optionally, according to the device for adjusting brightness provided by the embodiment of the present disclosure, the adjusting module configured to correspondingly adjust the duty ratio of one pulse period in the light emitting control signal by one unit each time the brightness of the OLED display needs to be adjusted by one unit according to the instruction, is specifically configured that:

the duty ratio of the pulse period with a maximum duty ratio in the light emitting control signal is correspondingly reduced by one unit each time the brightness of the OLED display needs to be lowered by one unit.

Optionally, according to the device for adjusting brightness provided by the embodiment of the present disclosure, the adjusting module is specifically configured to:

continuously adjust the light emitting control signal for M times when the brightness of the OLED display is continuously increased by M units according to the instruction; where the duty ratio of one pulse period in the light emitting control signal is correspondingly adjusted by one unit each time; the pulse periods of the light emitting control signal continuously adjusted twice are different; and M is an integer greater than 1.

Optionally, according to the device for adjusting brightness provided by the embodiment of the present disclosure, the adjusting module is configured that the pulse periods of the light emitting control signal continuously adjusted twice are not adjacent.

Optionally, according to the device for adjusting brightness provided by the embodiment of the present disclosure, the adjusting module is configured that the pulse periods of the light emitting control signal continuously adjusted twice are separated by one pulse period.

Optionally, according to the device for adjusting brightness provided by the embodiment of the present disclosure, the adjusting module is configured that: the duty ratios of the pulse periods at the odd positions in the light emitting control signal are preferentially adjusted; and the duty ratios of the pulse periods at the even positions in the light emitting control signal are adjusted when the duty ratios of the pulse periods at the odd positions are all adjusted; or the adjusting module is configured that: the duty ratios of the pulse periods at the even positions in the light emitting control signal are preferentially adjusted; and the duty ratios of the pulse periods at the odd positions in the light emitting control signal are adjusted when the duty ratios of the pulse periods at the even positions are all adjusted.

Figure 6:
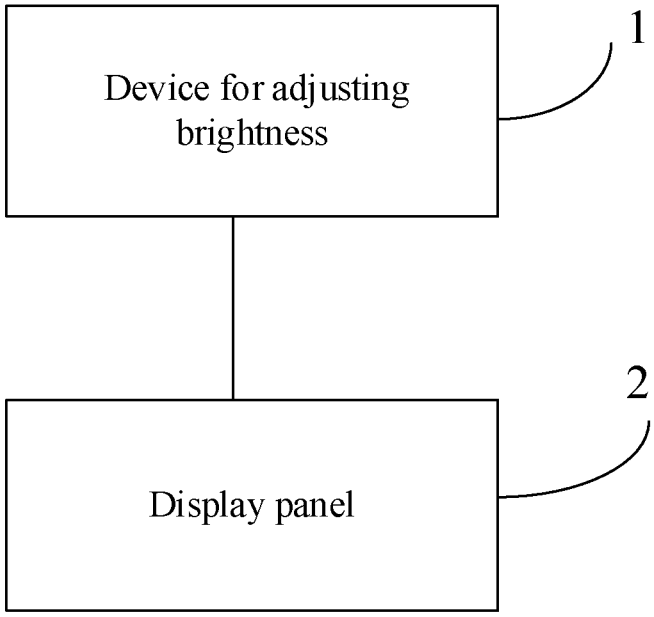
FIG. 6 is a structural schematic diagram of an OLED display provided by the embodiment of the present disclosure.

Based on the same inventive concept, an embodiment of the present disclosure also provides an OLED display, as shown in FIG. 6, including a display panel 2 and any one of the devices 1 for adjusting brightness provided by an embodiment of the disclosure. Since the principle of solving the problem of the OLED display is similar to that of the device for adjusting brightness, the OLED display may be implemented by reference to the device for adjusting brightness, and the repetition is not described here.

In a specific implementation, the OLED display device may be any product or component with display function, such as a mobile phone, a tablet computer, a TV, a display, a laptop, a digital photo frame and a navigator, which is not limited here.

According to the method and device for adjusting brightness and the OLED display provided by the embodiment of the present disclosure, an instruction for adjusting the brightness of the OLED display is received; and then the light emitting control signal is adjusted according to the brightness value of the OLED display which is needed to be adjusted in the instruction. The duty ratio of one pulse period in the light emitting control signal is correspondingly adjusted by one unit each time the brightness of the OLED display needs to be adjusted by one unit, which reduces the brightness value of one unit of brightness of the OLED display, avoids excessive brightness jump when the display adjusts the brightness bar, and improves the user experience compared with the existing methods for adjusting brightness.

It will be clear to those skilled in the art that various modifications and variations may be made to the present disclosure without departing from the spirit and scope of the present disclosure. Thus, if these modifications and variations of the present disclosure fall within the scope of the claims of the present disclosure and their equivalents, the present disclosure is also intended to include these modifications and variations.

What is claimed is:

1. A method for adjusting brightness of an organic light emitting diode (OLED) display, wherein when the OLED display displays each frame, a light emitting control signal sent to each row of pixels has N pulse periods; N is an integer greater than or equal to 2; and the method for adjusting brightness comprises:

receiving an instruction for adjusting the brightness of the OLED display; and adjusting the light emitting control signal according to a brightness value of the OLED display which is needed to be adjusted in the instruction; wherein a duty ratio of one pulse period in the light emitting control signal is correspondingly adjusted by one unit each time the brightness of the OLED display needs to be adjusted by one unit; and the greater the duty ratio, the higher the brightness of the display;

wherein an operation that the duty ratio of one pulse period in the light emitting control signal is correspondingly adjusted by one unit each time the brightness of the OLED display needs to be adjusted by one unit, comprises that:

the duty ratio of the pulse period with a minimum duty ratio in the light emitting control signal is correspondingly increased by one unit each time the brightness of the OLED display needs to be increased by one unit.

2. The method according to claim 1, wherein an operation that the duty ratio of one pulse period in the light emitting control signal is correspondingly adjusted by one unit each time the brightness of the OLED display needs to be adjusted by one unit, specifically comprises that:

the duty ratio of the pulse period with a maximum duty ratio in the light emitting control signal is correspondingly reduced by one unit each time the brightness of the OLED display needs to be lowered by one unit.

3. The method according to claim 1, wherein the adjusting the light emitting control signal according to the brightness value of the OLED display which is needed to be adjusted in the instruction, specifically comprises:

continuously adjusting the light emitting control signal for M times when the brightness of the OLED display needs to be continuously increased by M units according to the instruction;

wherein the duty ratio of one pulse period in the light emitting control signal is correspondingly adjusted by one unit each time, pulse periods of the light emitting control signal continuously adjusted twice are different, and M is an integer greater than 1.

4. The method according to claim 3, wherein the pulse periods of the light emitting control signal continuously adjusted twice are not adjacent.

5. The method according to claim 4, wherein the pulse periods of the light emitting control signal continuously adjusted twice are separated by one pulse period.

6. The method according to claim 3, comprising:

adjusting duty ratios of pulse periods at odd positions in the light emitting control signal; and adjusting duty ratios of pulse periods at even positions in the light emitting control signal when the duty ratios of the pulse periods at the odd positions are all adjusted; or adjusting duty ratios of pulse periods at even positions in the light emitting control signal; and adjusting duty ratios of pulse periods at odd positions in the light emitting control signal when the duty ratios of the pulse periods at the even positions are all adjusted.

7. A device for adjusting brightness of an organic light emitting diode (OLED) display, comprising:

a receiving module, configured to receive an instruction for adjusting the brightness of the OLED display; and an adjusting module, configured to adjust a light emitting control signal according to a brightness value of the OLED display which is needed to be adjusted in the instruction; wherein a duty ratio of one pulse period in the light emitting control signal is correspondingly adjusted by one unit each time the brightness of the OLED display needs to be adjusted by one unit; and the greater the duty ratio, the higher the brightness of the displays;

wherein the adjusting module is configured to: correspondingly increase the duty ratio of the pulse period with a minimum duty ratio in the light emitting control signal by one unit each time the brightness of the OLED display needs to be increased by one unit.

8. The device according to claim 7, wherein the adjusting module is configured to:

correspondingly reduce the duty ratio of the pulse period with a maximum duty ratio in the light emitting control signal by one unit each time the brightness of the OLED display needs to be lowered by one unit.

9. The device according to claim 7, wherein the adjusting module is specifically configured to:

continuously adjust the light emitting control signal for M times when the brightness of the OLED display needs to be continuously increased by M units according to the instruction;

wherein the duty ratio of one pulse period in the light emitting control signal is correspondingly adjusted by one unit each time, pulse periods of the light emitting control signal continuously adjusted twice are different, and M is an integer greater than 1.

10. The device according to claim 9, wherein the adjusting module is configured that the pulse periods of the light emitting control signal continuously adjusted twice are not adjacent.

11. The device according to claim 10, wherein the adjusting module is configured that the pulse periods of the light emitting control signal continuously adjusted twice are separated by one pulse period.

12. The device according to claim 9, wherein the adjusting module is configured to: adjust duty ratios of pulse periods at odd positions in the light emitting control signal, and adjust duty ratios of pulse periods at even positions in the light emitting control signal when the duty ratios of the pulse periods at the odd positions are all adjusted; or the adjusting module is configured to: adjust duty ratios of pulse periods at even positions in the light emitting control signal, and adjust duty ratios of pulse periods at odd positions in the light emitting control signal when the duty ratios of the pulse periods at the even positions are all adjusted.

13. An OLED display, comprising a display panel and the device for adjusting brightness according to claim 7.

* * * * *